US007651448B2

(12) United States Patent
Hetrick

(10) Patent No.: US 7,651,448 B2
(45) Date of Patent: Jan. 26, 2010

(54) METHOD OF USING AN ADJUSTABLE EXERCISE DEVICE

(75) Inventor: Randal A. Hetrick, San Francisco, CA (US)

(73) Assignee: Fitness Anywhere, Inc.

( * ) Notice: Subject to any disclaimer, the term of this patent is extended or adjusted under 35 U.S.C. 154(b) by 131 days.

(21) Appl. No.: 11/296,196

(22) Filed: Dec. 7, 2005

(65) Prior Publication Data

US 2006/0116252 A1 Jun. 1, 2006

Related U.S. Application Data

(63) Continuation of application No. 10/410,691, filed on Apr. 9, 2003, now Pat. No. 7,044,896.

(51) Int. Cl.
*A63B 21/068* (2006.01)
*A63B 23/02* (2006.01)

(52) U.S. Cl. ..... 482/95; 482/140; 482/141; 482/904; 482/907

(58) Field of Classification Search ..... 482/23, 482/24, 33, 34, 91–93, 95, 96, 120, 131, 482/148, 139–142, 904, 907
See application file for complete search history.

(56) References Cited

U.S. PATENT DOCUMENTS

| | | | | | |
|---|---|---|---|---|---|
| 2,716,027 | A | | 8/1955 | Gehri | 482/131 |
| 3,369,809 | A | * | 2/1968 | Morrill, Jr. | 482/91 |
| 3,411,776 | A | * | 11/1968 | Holkesvick et al. | 482/120 |
| 3,532,189 | A | * | 10/1970 | Wade | 188/65.3 |
| 3,608,900 | A | | 9/1971 | Welch | 482/120 |
| 3,677,543 | A | * | 7/1972 | Richardson | 482/129 |
| 3,752,474 | A | | 8/1973 | Macabet et al. | 482/131 |
| 3,910,573 | A | * | 10/1975 | Jamba | 482/91 |
| 3,966,204 | A | * | 6/1976 | Dubach | 482/93 |
| 3,979,114 | A | * | 9/1976 | Codina | 482/131 |

(Continued)

FOREIGN PATENT DOCUMENTS

AU 727828 B * 1/2001

(Continued)

OTHER PUBLICATIONS

Bodybuilder's Discount Outlet, Tricep Rope (1), pp. 27-28, summer 1995 catalog.

(Continued)

*Primary Examiner*—Loan H Thanh
*Assistant Examiner*—Victor K Hwang
(74) *Attorney, Agent, or Firm*—Steven R. Vosen

(57) ABSTRACT

A method for using an adjustable exercise device is described that allows for performing a wide variety of different exercises. In one embodiment the exercise device includes an elongated member with ends for supporting a user by their hands, fingers, feet and/or legs, where the device is movably supportable by a structure. The method includes adjusting the distance between the ends, positioning the device relative to the structure, and exercising. The user may support a portion of their weight on the ground and a portion from the ends of the device, and exercise by moving their body with their body thus supported. In alternative embodiments, the device may be supported by a door, a pole, a tree or some other suitable structure.

34 Claims, 16 Drawing Sheets

U.S. PATENT DOCUMENTS

| | | | | | |
|---|---|---|---|---|---|
| 4,019,734 | A | * | 4/1977 | Lee et al. | 482/125 |
| 4,059,265 | A | * | 11/1977 | Wieder et al. | 482/125 |
| 4,060,240 | A | | 11/1977 | Dunston | 482/131 |
| 4,343,466 | A | | 8/1982 | Evans | 482/120 |
| 4,441,707 | A | | 4/1984 | Bosch | 482/131 |
| 4,522,391 | A | * | 6/1985 | Rundall | 482/40 |
| 4,560,160 | A | | 12/1985 | Smith | 482/120 |
| 4,685,671 | A | | 8/1987 | Hagerman et al. | 482/124 |
| 4,733,862 | A | * | 3/1988 | Miller | 482/126 |
| 4,836,537 | A | * | 6/1989 | Moreno | 482/139 |
| 4,909,505 | A | | 3/1990 | Tee | |
| 5,131,650 | A | * | 7/1992 | Hall | 482/126 |
| 5,209,712 | A | * | 5/1993 | Ferri | 482/91 |
| 5,234,395 | A | | 8/1993 | Miller et al. | 482/118 |
| 5,254,065 | A | | 10/1993 | Pollack | 482/129 |
| 5,352,172 | A | | 10/1994 | Suzaki | 482/120 |
| 5,352,174 | A | | 10/1994 | Mason et al. | 482/129 |
| 5,399,137 | A | | 3/1995 | Kushner | 482/114 |
| 5,433,688 | A | | 7/1995 | Davies | 482/124 |
| 5,505,677 | A | * | 4/1996 | Hinds | 482/10 |
| 5,518,486 | A | | 5/1996 | Sheeler | |
| 5,549,532 | A | * | 8/1996 | Kropp | 482/126 |
| 5,556,369 | A | | 9/1996 | Roberts | |
| 5,569,140 | A | * | 10/1996 | Elliman | 482/140 |
| 5,571,064 | A | | 11/1996 | Holm | 482/129 |
| 5,624,360 | A | | 4/1997 | Wilkins | |
| 5,795,274 | A | | 8/1998 | Kasbohm | 482/115 |
| 5,800,322 | A | | 9/1998 | Block | |
| 5,807,214 | A | | 9/1998 | Riazi | 482/129 |
| 5,842,961 | A | | 12/1998 | Davis | 482/139 |
| 5,885,190 | A | * | 3/1999 | Reiter | 482/69 |
| 5,916,070 | A | | 6/1999 | Donohue | 482/74 |
| 5,921,903 | A | * | 7/1999 | Lawrence | 482/140 |
| 6,102,837 | A | | 8/2000 | Hubbard | 482/120 |
| 6,113,564 | A | * | 9/2000 | McGuire | 602/32 |
| 6,258,011 | B1 | | 7/2001 | Wolfe | 482/23 |
| 6,322,483 | B1 | | 11/2001 | Rotella | 482/129 |
| 6,348,026 | B1 | | 2/2002 | Kuo | |
| 6,450,929 | B1 | | 9/2002 | Markham | |
| 6,500,103 | B2 | | 12/2002 | Porter | 482/121 |
| 6,524,226 | B2 | * | 2/2003 | Kushner | 482/126 |
| 6,921,354 | B1 | | 7/2005 | Shifferaw | 482/91 |
| 7,044,896 | B2 | | 5/2006 | Hetrick | |
| 7,090,622 | B2 | | 8/2006 | Hetrick | |
| 7,255,666 | B2 | * | 8/2007 | Cardenas | 482/143 |
| 7,438,674 | B2 | * | 10/2008 | Sjodin | 482/91 |
| 2002/0022555 | A1 | | 2/2002 | Nesci | |
| 2005/0003938 | A1 | * | 1/2005 | Henderson | 482/143 |
| 2007/0027005 | A1 | * | 2/2007 | Hetrick | 482/91 |
| 2007/0066450 | A1 | * | 3/2007 | Hetrick | 482/91 |
| 2007/0173383 | A1 | * | 7/2007 | Feigenbaum et al. | 482/91 |
| 2008/0076642 | A1 | * | 3/2008 | Hetrick | 482/95 |
| 2008/0293545 | A1 | * | 11/2008 | Planke | 482/7 |
| 2009/0075787 | A1 | * | 3/2009 | Hetrick | 482/91 |
| 2009/0075788 | A1 | * | 3/2009 | Hetrick | 482/91 |
| 2009/0075789 | A1 | * | 3/2009 | Hetrick | 482/91 |
| 2009/0075790 | A1 | * | 3/2009 | Hetrick | 482/92 |
| 2009/0075794 | A1 | * | 3/2009 | Hetrick | 482/139 |
| 2009/0105053 | A1 | * | 4/2009 | Hetrick | 482/133 |

FOREIGN PATENT DOCUMENTS

| | | | | |
|---|---|---|---|---|
| DE | 19527241 | A1 | * | 1/1997 |
| JP | 2003275341 | A | | 9/2003 |
| WO | WO 2005/014119 | A1 | * | 2/2005 |

OTHER PUBLICATIONS

Dosho Design, Inc., Jam Gym description, www.jamgym.com/jamGym.php, Jan. 6, 2003.

Jam Gym Manual, Dosho Design, Inc., downloaded from website (www.jamGym.com/jamGym.php), Jan. 6, 2003.

Hetrick, Randal, co-pending U.S. Appl. No. 11/419,320, filed May 19, 2006.

Hetrick, Randal, co-pending U.S. Appl. No. 11/557,050, filed Nov. 6, 2006.

Hetrick, Randal, co-pending U.S. Appl. No. 11/948,860, filed Nov. 30, 2007.

Hetrick, Randal, co-pending U.S. Appl. No. 11/948,863, filed Nov. 30, 2007.

Hetrick, Randal, co-pending U.S. Appl. No. 11/948,868, filed Nov. 30, 2007.

Hetrick, Randal, co-pending U.S. Appl. No. 11/948,872, filed Nov. 30, 2007.

Hetrick, Randal, co-pending U.S. Appl. No. 11/948,875, filed Nov. 30, 2007.

Hetrick, Randal, co-pending U.S. Appl. No. 11/948,876, filed Nov. 30, 2007.

* cited by examiner

FIG._12B"

METHOD OF USING AN ADJUSTABLE EXERCISE DEVICE

CROSS-REFERENCE TO RELATED APPLICATIONS

This application is a continuation of U.S. application Ser. No. 10/410,691, filed Apr. 9, 2003, which issued as U.S. Pat. No. 7,044,896 on May 16, 2006, the contents of which are hereby incorporated herein by reference.

FIELD OF THE INVENTION

The present invention relates to exercise devices, and in particular, to an exercise device having an inelastic strap that is easily configurable for use in performing a wide variety of exercises.

BACKGROUND OF THE INVENTION

Resistance exercise devices allow a user to exercise by providing a resistance to the movement of a user's arms, legs, or torso. Resistance is normally provided by working one muscle against another, or against gravity, and may include elastic bands to provide an increased resistance force. The usefulness of these devices depends, in part, on the ease with which a user can perform different types of exercises, the range or number of exercises that can be performed with the device, and the ease with which different users can adjust the device according to their height, weight, strength, and/or physical limitations.

Resistance exercise devices having elastic bands typically restrict the motion of a user's arms and/or legs, or the motion between the user and a support structure. Elastic exercise devices can be small, even portable, but have limited usefulness that result from their resistance characteristics, which depend on the length and elasticity of the elastic band. As a result of these characteristics, the elastic bands are useful for a specific length range, thus restricting the diversity of exercises for which it can be used. In addition, it may not be possible for different users to use the same device for the same exercise due to differences in height, weight, or strength between different users. Thus, for an elastic device to be generally useful, such as to provide a complete workout or to allow for different users, a plurality of elastic bands are required that must be easily interchangeable. No known prior art device provides the ease of use necessary to be generally useful across a wide range of exercises.

Another limitation of elastic resistance exercise devices is that the resistance is inconsistent and increases with increasing displacement, and also tends to snap back when the user decreases his or her effort. While this resistance response provides for a compact design, it is problematic as it does not recreate the resistance encountered by muscles during more natural types of exercising, such as running, swimming, etc. Yet another limitation of elastic devices is the inability to support a wide range of weight of the user—typically the devices are adapted to support only the resistance provided by the user's muscles. This creates extreme limitations in the exercises that can be performed by any individual elastic device. For this reason, elastic devices must be used over a limited range of stances, further limiting the user's workout.

Another type of resistance exercise device provides an inelastic strap that is attachable to a fixed location such as, for example, a door. These devices may overcome some of the limitations of the elastic devices previously discussed by providing inelastic straps that can be anchored between a door and a doorjamb. One of these devices has a fixed length strap attached to a door through a pulley system that allows the user to exercise by moving the arms in opposite directions. Another of these devices has a pair of fixed length straps anchored to a door. Both of these devices are of limited usefulness because of their fixed length and the range of exercises for which they can be used.

There is a need to provide a resistance exercise device that is easily adjustable so that it can provide a complete workout for any user, including adjustments that allow a wide range of stances and exercises, and that provides resistance to the user's motion in a form that is useful for exercising. In addition, there is a need to provide such a device that is adaptable to be easily portable to enable the device to be mounted to different locations for exercising.

SUMMARY OF THE INVENTION

The present invention solves the above-identified problems of known resistance exercise devices by providing an inelastic device that is easily adjustable over a large range of lengths, and that can provide resistance ranging from nearly zero to the full body weight of the user. In one embodiment, the present invention provides an exercise device having an elongated member with a grip at both ends and an anchor between the grips for attaching to a structure, where the length of the elongated member is adjustable and where the anchor provides for the elongated member to center on the anchor when the grips are pulled. The device therefore allows a user to easily vary the length of the device and to balance according to the forces applied to the grips. In particular, by positioning the grips equidistant to the anchor while pulling on the grips, the device effectively centers the elongated member on the anchor. Thus, for a user that positions her feet equidistant from the anchor and pulls back to support her weight on the device, the lengths of the two arms of the elongated member are distributed equally, thus creating a balanced device.

It is one aspect of the present invention to provide an adjustable, inelastic exercise device comprising an elongated member having a pair of ends separated by a length and a mechanism for adjusting the length. The pair of ends includes a first end having a first grip and a second end having a second grip. The device also includes an anchor having a first portion for mounting the device to a structure and a second portion to support the elongated member at a position along the length when both of the grips are pulled in a direction away from the anchor. The support and elongated member interact to provide frictional restraint with respect to the anchor as a function of the force applied to each of the pulled grips. Thus in one embodiment, the frictional restraint restrains the elongated member with the grips equidistant from the anchor when the sum of the forces is increased while the user positions each of the grips a distance of one half of the length from said anchor.

It is another aspect of the present invention to provide an adjustable, inelastic exercise device comprising an elongated member including at least one strap, a pair of ends separated by a length, and a pair of cam buckles including a first cam buckle adjacent to one of said pair of ends and a second cam buckle adjacent to the other of said pair of ends. The length of the elongated member is adjustable according to the length of strap through the cam buckles. The device also includes an anchor having a first portion for mounting the device to a structure and a second portion to support the elongated member at a position along the length when both of the grips are pulled in a direction away from the anchor. The support and elongated member interact to provide frictional restraint with respect to the anchor as a function of the force applied to each of the pulled grips. Thus in one embodiment, the frictional restraint restrains the elongated member with the grips equidistant from the anchor when the sum of the forces is increased while the user positions each of the grips a distance of one half of the length from said anchor.

It is yet another aspect of the present invention to provide an adjustable, inelastic exercise device comprising an elongated member having a pair of ends separated by a length and a mechanism for adjusting the length. The pair of ends includes a first end having a first grip and a second end having a second grip. The device also includes an anchor having a first portion for mounting the device to a structure and a second portion to support the elongated member at a position along the length when both of the grips are pulled in a direction away from the anchor. The support and elongated member interact to provide frictional restraint with respect to the anchor as a function of the force applied to each of the pulled grips. Thus in one embodiment, the frictional restraint restrains the elongated member with the grips equidistant from the anchor when the sum of the forces is increased while the user positions each of the grips a distance of one half of the length from said anchor.

One aspect of the present invention is to provide a substantially inelastic exercise device that can be anchored to a structure and that has an adjustable length that is self-centering about an anchor point upon pulling by the user.

Another aspect of the present invention is to provide an exercise device that can be anchored to a structure and exert a substantially inelastic resistance to the motion of a user through a pair of arms, each with a grip, having an adjustable length that centers about the anchor when pulled by the user.

It is another aspect of the present invention to provide an adjustable and essentially self-centering exercise device that can support up to the full weight of the user.

It is yet another aspect of the present invention to provide a portable exercise device that can be easily attachable to a structure and that can provide a complete workout of user determined intensity, resistance, and effort.

These features together with the various ancillary provisions and features which will become apparent to those skilled in the art from the following detailed description, are attained by the exercise device of the present invention, preferred embodiments thereof being shown with reference to the accompanying drawings, by way of example only, wherein:

BRIEF DESCRIPTION OF DRAWINGS

FIG. 5A is a perspective view, and FIG. 5B is sectional view 5B-5B;

FIG. 12A is the initial configuration, FIG. 12B illustrates lengthening the elongated member, further illustrated in FIGS. 12B' and 12B", FIG. 12C shows the application of force to the shorter leg of the elongated member, and FIG. 12D shows the application of force to the grips during an exercise;

FIG. 13A is the initial configuration, FIG. 13B shows the application of force to one of the pair of legs, and FIG. 13C shows the application of force to the grips during an exercise;

FIG. 15A is a reverse combination crunch, FIG. 15B is a single leg L-squat, FIG. 15C is a gymnast dip, FIG. 15D is a kneeling combination crunch, FIG. 15E is a lying leg curl, FIG. 15F is a hip lift, FIG. 15G is a front shoulder raise, FIG. 15H is a crunch, and FIG. 15I is a tricep extension; FIG. 16A shows interlocking the handles for one handed exercises, and FIG. 16B illustrates the use of the exercise device in performing a one arm high row exercise.

Reference symbols are used in the Figures to indicate certain components, aspects or features shown therein, with reference symbols common to more than one Figure indicating like components, aspects or features shown therein.

DETAILED DESCRIPTION

Figure 2:
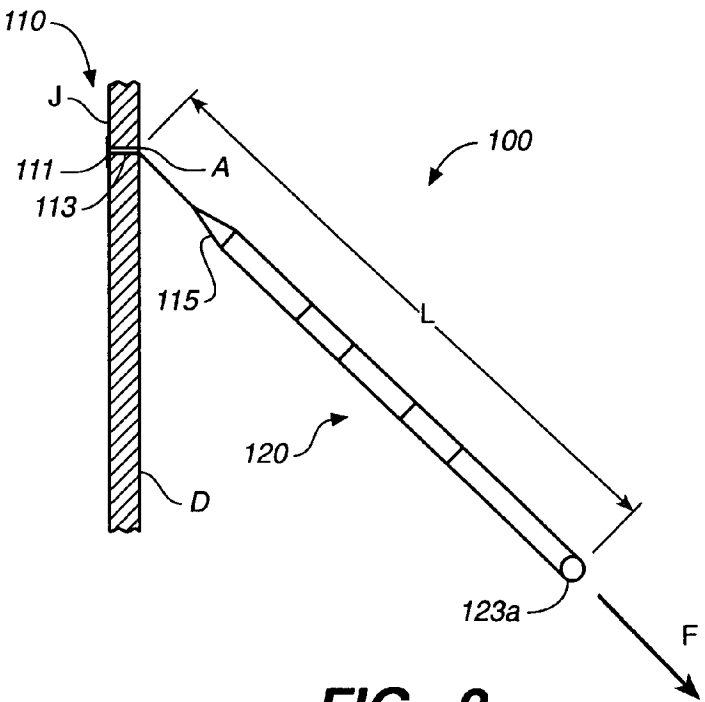
FIG. 2 is a partial schematic sectional view 2-2 of FIG. 1 showing the exercise device anchored between a door and door jamb.
Figure 1:
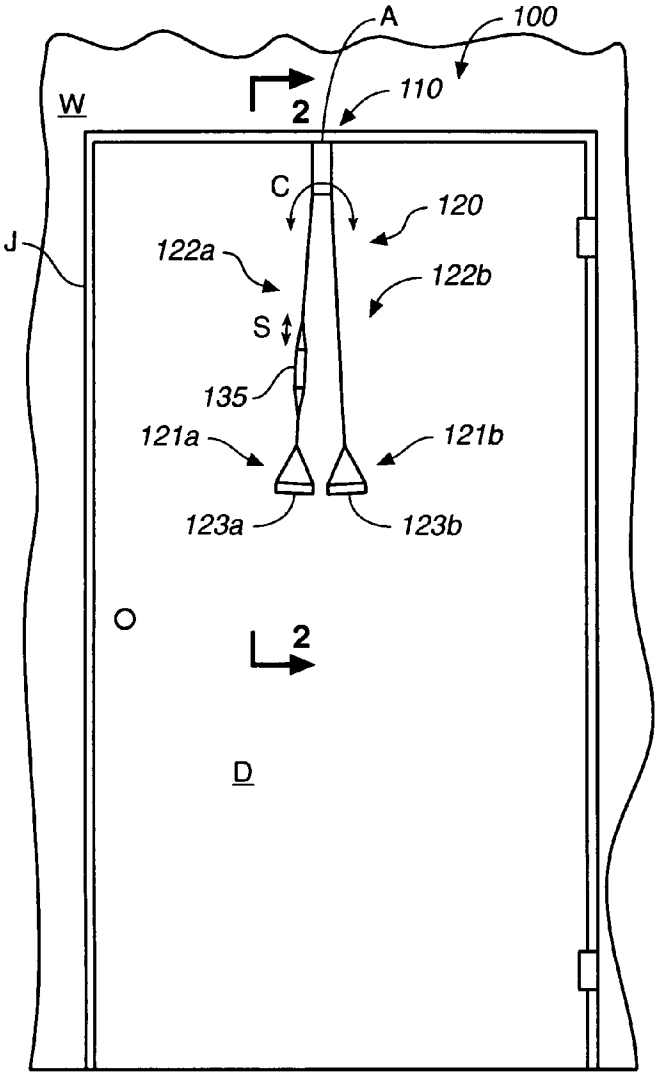
FIG. 1 is a schematic front view of one embodiment of an exercise device of the present invention as anchored between a door and door jamb.

In general, the present invention provides an inelastic exercise device that is supported by, or that can be easily attached to, a supporting structure, and that allows a user to perform a large number of exercises by easily adjusting the length of the device and thereafter balancing the device as the user transfers his weight to the device. Several of the features of the present invention will now be illustrated with reference to FIGS. 1-3, which show the set-up and use of the device of the present invention, and which is not meant to limit the scope of the present invention. FIG. 1 is a schematic front view of one embodiment of exercise device 100 that is anchored at a point A between a door D and door jamb J. FIG. 2 is a partial sectional view 2-2 of FIG. 1 taken through door D and showing exercise device 100 in profile, and FIG. 3 is illustrative of a user U exercising with the exercise device of FIG. 1.

In general, exercise device 100 includes an anchor 110 and an elongated member 120 having a pair of arms 122, indicated as a first arm 122*a* and a second arm 122*b*, on either side of the anchor, as shown schematically in FIGS. 1 and 2. A pair of grips 123 is provided, with one positioned at the end of each arm 122, specifically first arm 122*a* has a first grip 123*a*, and second arm 122*b* has a second grip 123*b*. Elongated member 120 is substantially inelastic with a length S between the pair of grips 123, and a lengthening mechanism 135 that provides for increasing or decreasing the length S, as indicated by double arrows ΔS.

Figure 3:
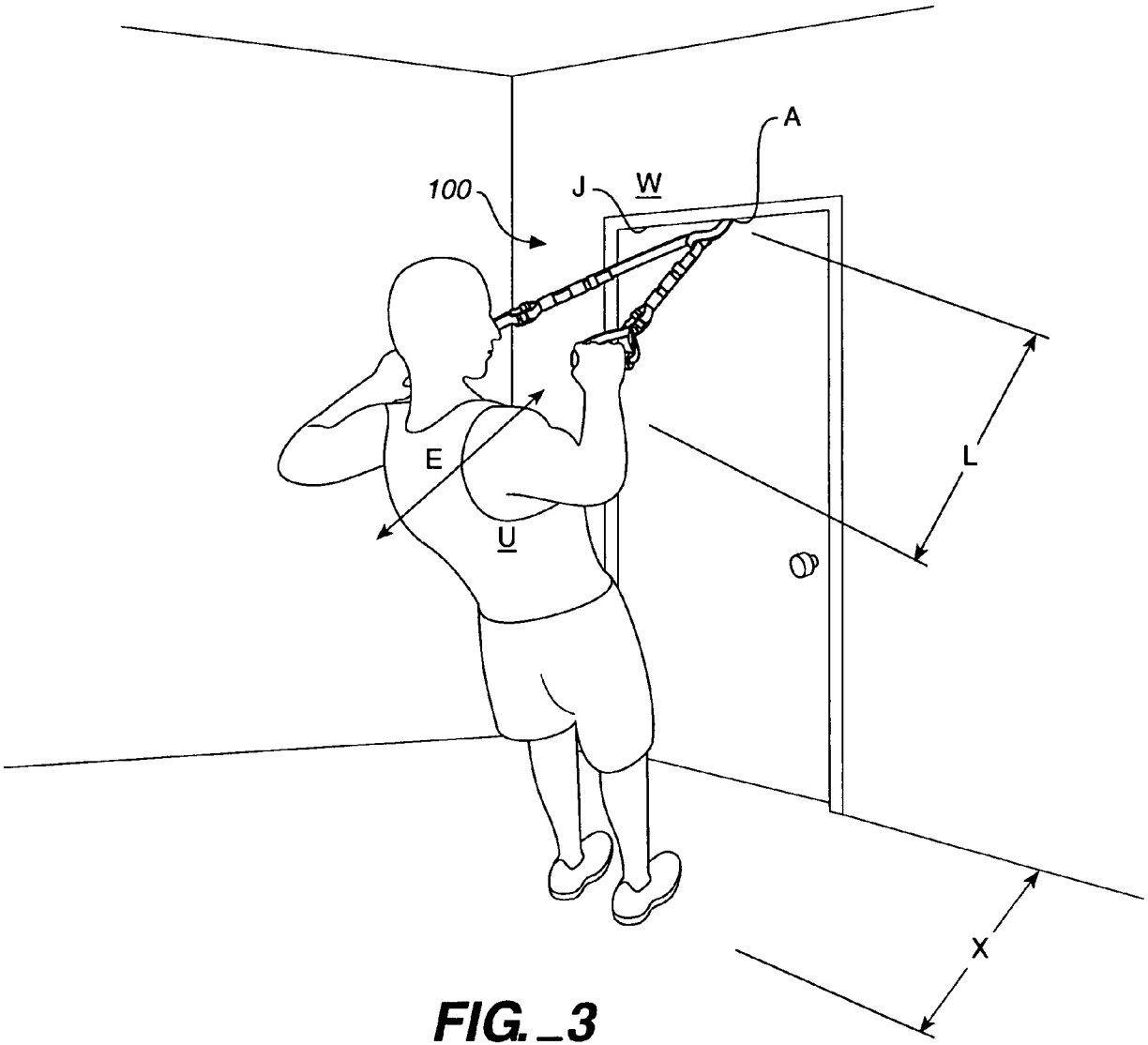
FIG. 3 is illustrative of a user performing a high row exercise with the exercise embodiment of FIG. 1.

Anchor 110 is used to provide a fixed anchor point for exercise device 100 and to support a user's weight as it is applied to arms 122 as indicated by an arrow F in FIG. 2 and as shown in FIG. 3. As shown in FIG. 2, anchor 110 is adapted for positioning exercise device 100 in a door and providing support to elongated member 120 by having an enlarged portion 111, a strap portion 113, and an approximately triangular shaped loop 115 for slidably supporting the elongated member. With enlarged portion 111 on the opposite side of door D from elongated member 120, anchor 110 supports the weight of a user as grips 123 are pulled. In addition, anchor 110 provides for positioning the relative length of arms 122 as shown in FIG. 1 by double arrow C. Thus, the total length of elongated member 120 and distribution of that length between each of arms 122 can be easily adjusted through the lengthening mechanism 135 and by pulling the ends of the elongated member. FIG. 2 shows arms 122 each having a length L.

When supported by a structure, such as door D (shown in FIGS. 1-3) or a railing, pole or other support member (not shown) the inventive exercise device provides a pair of grips for a user to exercise against her weight according the user's position relative to the device, and provides for easily adjusting the length of the device. As described below, the inventive device can be used to exercise in any one of a large number of orientations according the selected adjustable length and according to where and how the user stands relative to the exercise device. In general, a user sets the exercise device to a desired length, positions herself on the ground near the exercise device, supports a portion of her body weight from the exercise device by her hands or feet, and exercises by moving her body with her weight supported by the ground and the exercise device. Examples of support on the ground and exercise device include, but are not limited to, standing on one or both legs, lying on the stomach or the back, kneeling, or by having the hands on the ground, and having the exercise device support ones weight by the hands or feet, as appropriate.

With reference to FIG. 3, a user U is shown in one of the many exercise positions, in particular a high row exercise, gripping the pair of grips 123 with the user's hands and having the user's feet placed a horizontal distance X from anchor point A. When anchored to a door, it is preferred that anchor point A is on the inwards side of the door (that is, that the door open away from user U) so that jamb J can support the user's weight. The user U is shown leaning away from anchor point A and supporting a fraction of his or her weight through device 100. It is apparent that user U can vary the amount of supported weight, and thus the resistance of exercise device 100, by adjustment of his or her stance relative to anchor point A (distance X) and the length of arms 122 (length L). The user U of FIG. 3 performs a high row exercise by moving his body in a direction E towards and away from anchor point A. Note that other exercises are also possible with the user in this position by the user moving in other directions with the user's weight supported by the ground and exercise device 100.

Several embodiments of the present invention will now be described with reference to the drawings. These embodiments are meant to illustrate the invention, and are not meant to limit the scope of the invention.

Figure 4:
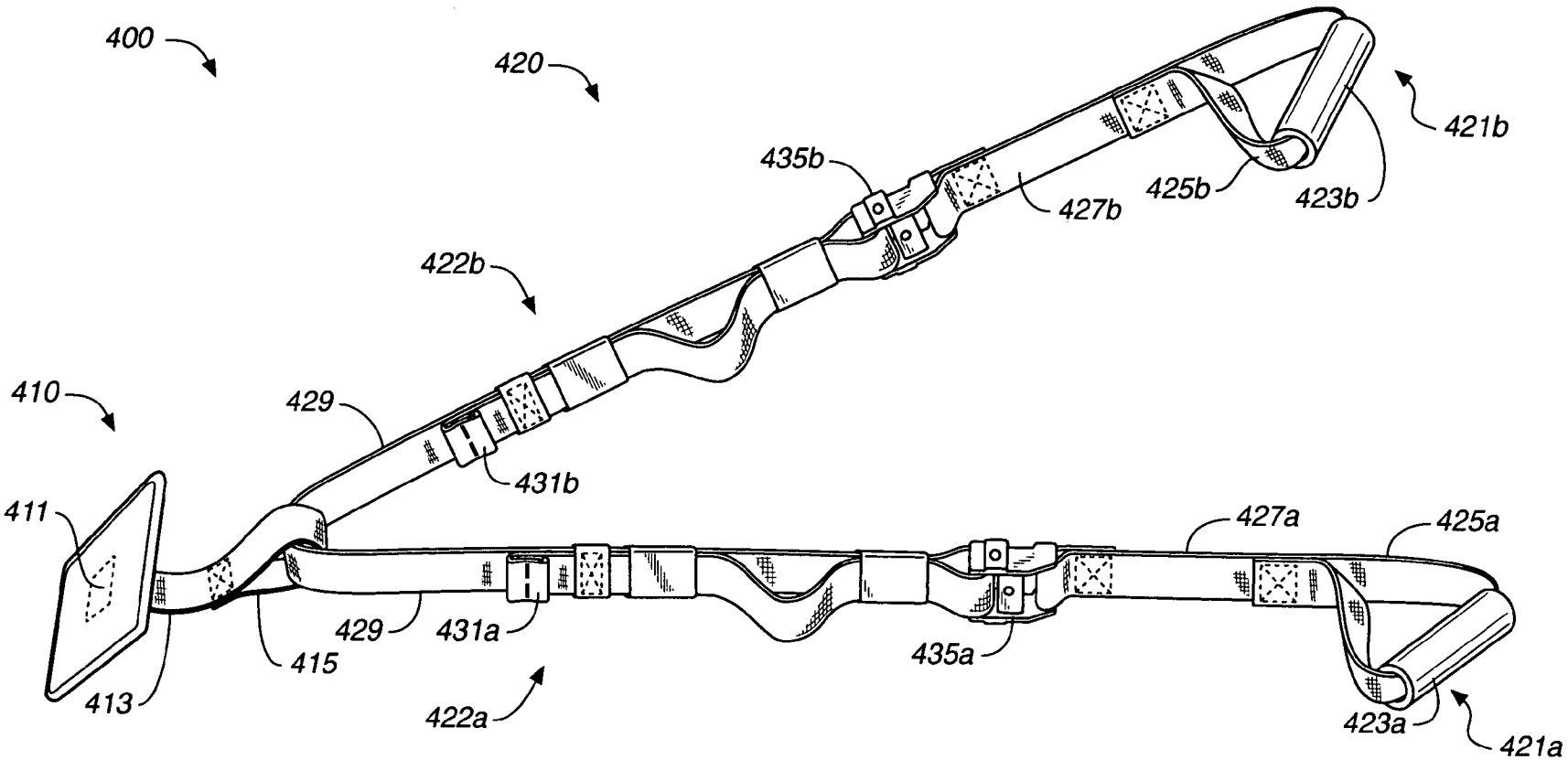
FIG. 4 is a perspective view of another embodiment of the exercise device of the present invention.

FIGS. 4-9 are various views of another embodiment of an exercise device 400 of the present invention. Referring first to FIG. 4, a perspective view of exercise device 400 is shown as including an anchor 410 and an elongated member 420. Anchor 410 includes an inelastic, flexible strap 413 having an enlarged first end 411 that is wider than the strap, and a second end that forms a loop 415. Elongated member 420 passes through loop 415, defining a pair of arms 422, indicated as arm 422*a* and 422*b*. Each arm 422 has a respective end 421, shown as end 421*a* and 421*b*, each forming a loop 425, shown as loop 425*a* and 425*b*, to support one of a pair of grips 423, shown as grip 423*a* and 423*b*. Elongated member 420 also includes a pair of lengthening devices or buckles 435, shown as buckle 435*a* and 435*b*, at either end of a central strap 429 that provides for the adjustment of the length of the elongated member. Specifically, strap 429 has a pair of ends 431, indicated as 431*a* and 431*b*, that pass through buckle 435*a* and 435*b*, respectively. As described subsequently, elongated member 420 is substantially inelastic, with the length of the elongated member being adjustable through the action of one or both of the pair of buckles 435.

Figure 5A:
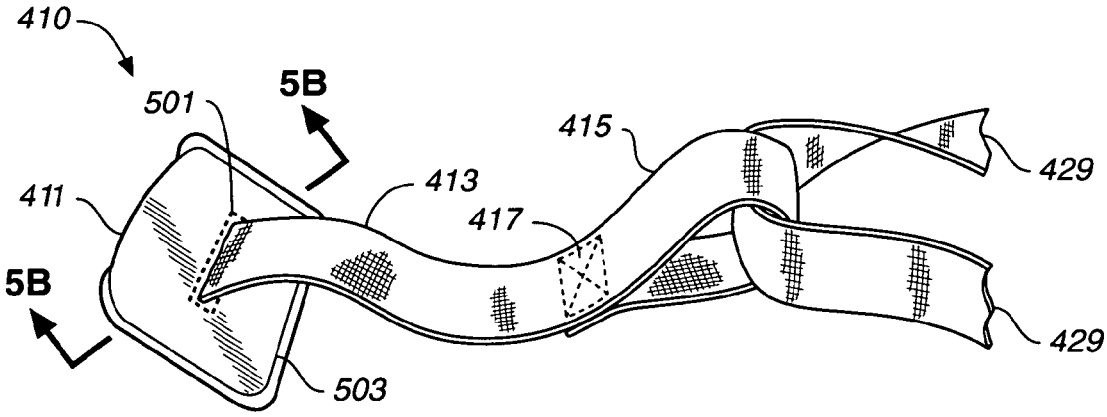
FIGS. 5A and 5B are views of the anchor portion of the exercise device of FIG. 4, where
Figure 5B:
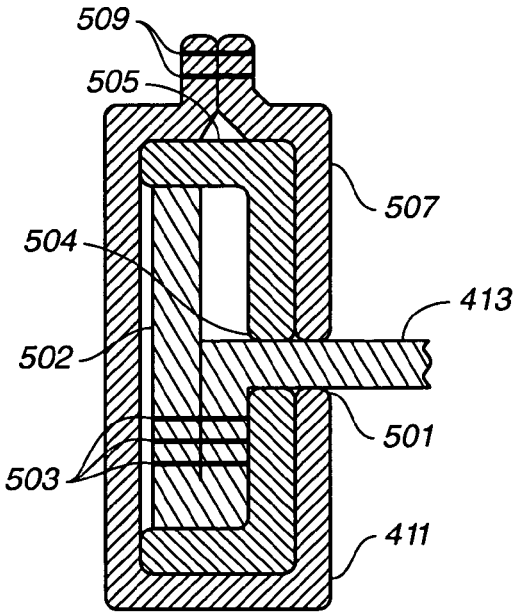

FIGS. 4, 5A and 5B present several views of anchor 410, where FIG. 5A is a perspective view of the anchor and FIG. 5B is a sectional view 5B-5B of the anchor. As noted previously, anchor 410 includes an inelastic, flexible strap 413. It is preferred that the majority of lengths of anchor 410 and elongated member 420 are formed of materials that include, but are not limited, to straps of a webbing of a natural or synthetic material having a strength sufficient to support the weight of a device user. Preferred webbings include, but are not limited to, webbings made of nylon, polypropylene or other polymeric fibers. It is understood that a single length of flexible material according to the present invention can alternatively comprise two or more pieces that are stitched, glued, or otherwise attached to one another. It is preferred that the length of anchor 410 is from 6 to 18 inches, or more preferably, approximately 12 inches.

Strap 413 has an enlarged first end 411 that is wider than the strap, and a second end 417 that is attached to the strap so as to form a loop 415. As shown in FIG. 5B, strap 413 has an end 502 forming the core of first end 411. Since one of the intended uses of anchor 410 is to anchor exercise device 400 between a door and jamb, it is preferable that the end 411 include materials that are soft enough to prevent damage to a wood door or door fame, yet be sturdy enough to support the weight of a user. One embodiment that is soft yet sturdy is shown in FIG. 5B. Specifically, strap end 502 is partially surrounded by a recessed enclosure 505 and a pillow 507 that covers the strap end and the enclosure. Strap end 502 can further be held within end 411 by gluing and stitching the strap end to enclosure 505 and pillow 507, and by closing the pillow with one or more stitches 509. Strap 413 passes into first end 411 through a slot 504 in enclosure 505 and through slot 501 in pillow 507. In a preferred embodiment, first end 411 is approximately 3.5" by 2.5" and is oriented approximately perpendicular to strap 413. It is also preferred that enclosure 505 is formed of a high-density, closed cell foam, and that pillow 507 is formed from a felt, and includes stitches 503. Alternatively, a second strap or piece of another material could be sewn, glued or otherwise attached to the end of strap 413 to form end 502. In another alternative embodiment, enclosure 505 can include another rigid member, such as a metal or hard plastic plate, to increase the rigidity of strap end 411.

Figure 6:
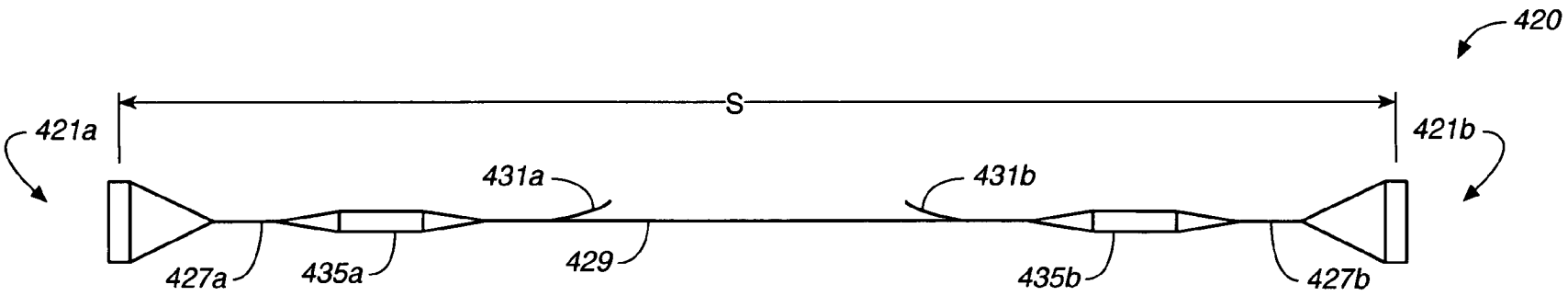
FIG. 6 is a schematic top view of the elongated member of the embodiment shown in FIG. 4 having two lengthening mechanisms and two hand grips.
Figure 7:
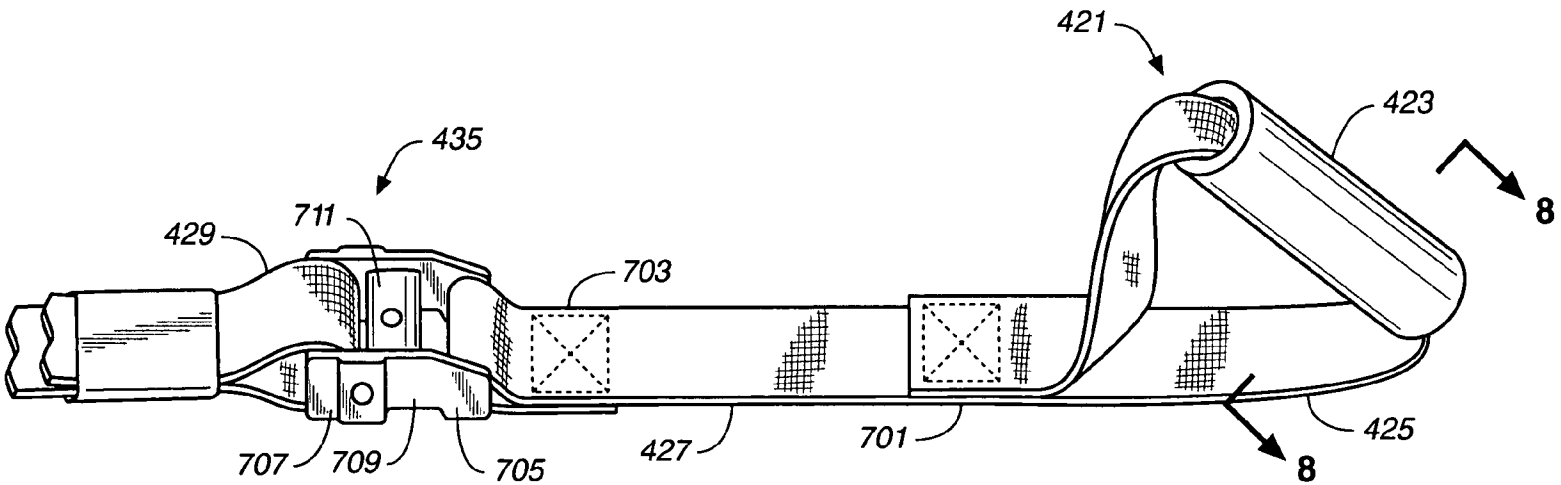
FIG. 7 is a perspective view showing details of the grip and the lengthening mechanism of the embodiment of FIG. 4.
Figure 8:
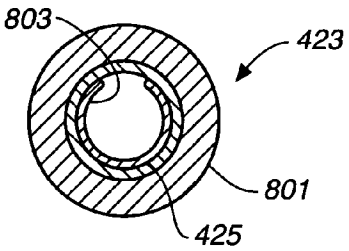
FIG. 8 is a sectional view 8-8 of FIG. 7 showing the hand grip.
Figure 9A:
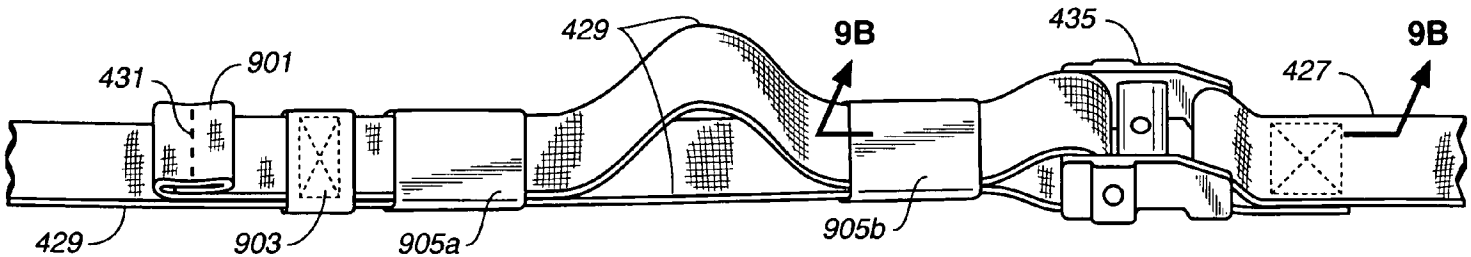
FIG. 9A is a perspective view showing details of the slack sleeves of the embodiment of FIG. 4.

Elongated member 420 is shown in greater detail in FIGS. 6-9, where FIG. 6 is a schematic top view of the elongated member, FIG. 7 is a perspective view of one of the pair of grips 421 and the corresponding one of the pair of buckles 435, FIG. 8 is a sectional view 8-8 of one of the pair of grips 421, and FIG. 9A is a perspective view showing details of one of the pair of buckles and the adjoining strap 429. As shown in FIG. 6, the elongated member 420 has length S, and includes two inelastic strap portions 427, indicated as 427*a* and 427*b*, strap 429 and the pair of buckles 435 for adjusting the length S. The portion of elongated member 420 from each end to the nearest buckle has a fixed length—that is, each of the two portions from one of the pair of ends 421 to the corresponding one of the pair of buckles 435 has a fixed length. It is preferred that the length S is adjustable over a length that allows for a wide range of exercises. Preferably, length S can be varied in length from approximately 6 feet to 12 feet. Also preferably, elongated member 420 has a width of approximately 1.5". It is also preferred that the surface finish of strap 429 and loop 415 allows the user to easily slide the elongated member 420 along anchor 410, while providing enough friction so that there can be some mis-match in forces on the two ends 421 without the elongated member sliding through the anchor while a user is exercising.

Figure 9B:
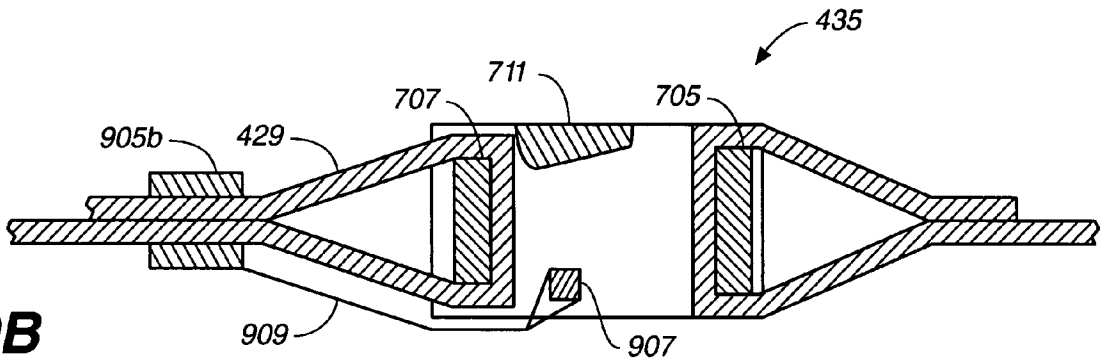
FIG. 9B is a sectional view 9B-9B of FIG. 9A showing details of the cam buckle and attachment of the slack sleeves to the cam buckle.

The details of one of the pair of ends 421, including strap 429 to grip 423, and including buckle 435 are shown in FIGS. 7, 9A and 9B. Buckle 435 is a cam buckle, the design and use of which are well known in the art. Buckle 435 is attached to strap 427, and thus the length of each of end 421 is not adjustable. Buckle 435 is also slidably accepts and grips strap 429, allowing for adjustment of the length S.

Buckle 435 has a frame 709, a first strap bar 705, a second strap bar 707, and a user movable cam 711. First strap bar 705 supports a loop of strap 427 that is preferably secured by stitches 703. Alternatively, strap 427 can be secured to bar 705 through a second member, such as another looped strap or a plastic or metal piece that loops about bar 705 and provides a location to attach strap 427. Strap 427 has an opposite end that is bound with stitches 701 to form a loop 425 to secure grip 423, as described subsequently. Second strap bar 707 and cam 711 supports strap 429. It is understood that the use of stitches as described herein to fasten strap portions can also be accomplished through the use of other methods of fastening, such as glue or by melting strap portions together.

Cam 711 is spring loaded such that it normally restrains a strap 429, and that under the action of a user, such as by pushing or pulling the cam, the cam is moved to allow the strap to move. The distance between cam 711 and bar 707 is adjusted by the user and a spring within buckle 435 by pushing on cam 711, allowing strap 429 to slide between cam 711 and bar 707. Thus, the length S can be adjusted by the user actuating cam 711 of buckle 435.

Grip 423 is shown in greater detail in the sectional view of FIG. 8. Grip 423 has a generally tubular shape, with an outer cover 801 and an inner cylindrical tubular portion 803. Cover 801 has a length and outer diameter to allow a hand to easily grab grip 423, and is formed from a material that permits a user to hold it while exercising. A preferred material for cover 801 is a high density foam. Portion 803 provides the strength of grip 423 and can be formed from a length and diameter of plastic or other rigid material to match the size of cover 801 and to provide space for loop 425 to pass through the center of portion 803. Portion 803 is preferably formed from a rigid and light material, such as PVC tubing.

One of the pair of free ends 431 is shown in greater detail in FIG. 9A. Each end 431 is preferably folded back, and is held in place, for example by a stitch 901, to form an easily manipulated end. Elongated member 420 also includes several sleeves, shown as sleeves 903, 905*a* and 905*b* that twice surrounds strap 429 to prevent ends 431 from moving about. Specifically, sleeves 903 and 905 are placed between buckles 435, ends 431 and strap 429. Thus sleeves 903 and 905 restrain the portion of strap 429 from a buckle 435 to the corresponding end 431 from moving about as exercise device 420 is moved. As shown in FIG. 9A, sleeve 903 is affixed near end 431, while sleeves 905 can be slid along the length of strap 429. FIG. 9B is a sectional view 9B-9B of FIG. 9A showing details of the cam buckle and attachment of sleeve 905*b*. In particular, FIG. 9B shows a bar 907 that spans buckle 435 and a strap 909 that is attached both the bar and to sleeve 905*b*. Strap 909 keeps sleeve 905*b* from sliding too far down strap 429 during adjustment of the length of the exercise device. It is preferred that sleeves 905*b* are elastic so that they can easily move and hold together the portions of strap 429.

Figure 10:
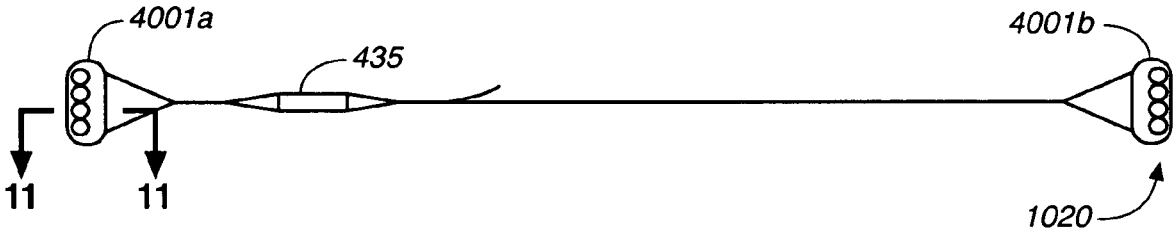
FIG. 10 is a schematic top view of an alternative elongated member embodiment having one lengthening mechanism and two finger grips.
Figure 11:
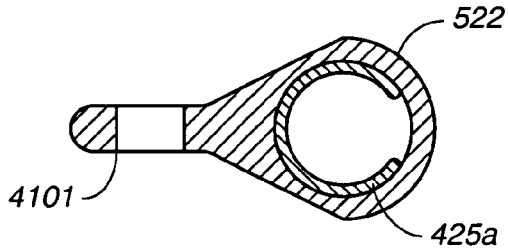
FIG. 11 is schematic sectional view 11-11 of the finger grip embodiment of FIG. 10.

While exercise device 400 has been described with respect to a particular embodiment, there are many alternative embodiments that are within the scope of the present invention. Thus, for example, there are many embodiments that provide for an adjustable length, substantially inelastic, strap-like member that has an easily adjustable length and balance of the two sides of the strap-like member about the anchor. One alternative embodiment is shown in FIGS. 10 and 11, where FIG. 10 is a schematic top view of an alternative elongated member 1020 having one cam buckle 435 as a lengthening device, and two finger grips 4001, and FIG. 11 is a sectional view of alternative finger grips. The use of one buckle 435 provides a lighter exercise device 400, but results in a smaller useful range of lengths for elongated member 1020. Finger grips 4001 include four holes 4101 for the user's fingers, and allows for exercise of one or more finger muscles. Modified finger grips can alternatively be provided as an "add-on" modification to elongated member 420, allowing the user to switch between finger and hand grips. A variety of other add-on grip accessories, not shown, can be used with exercise device 400, including but not limited to a rope grip for forearm development, a heel cup accessory for securing the feet to the handles for leg development exercises.

Figure 12A:
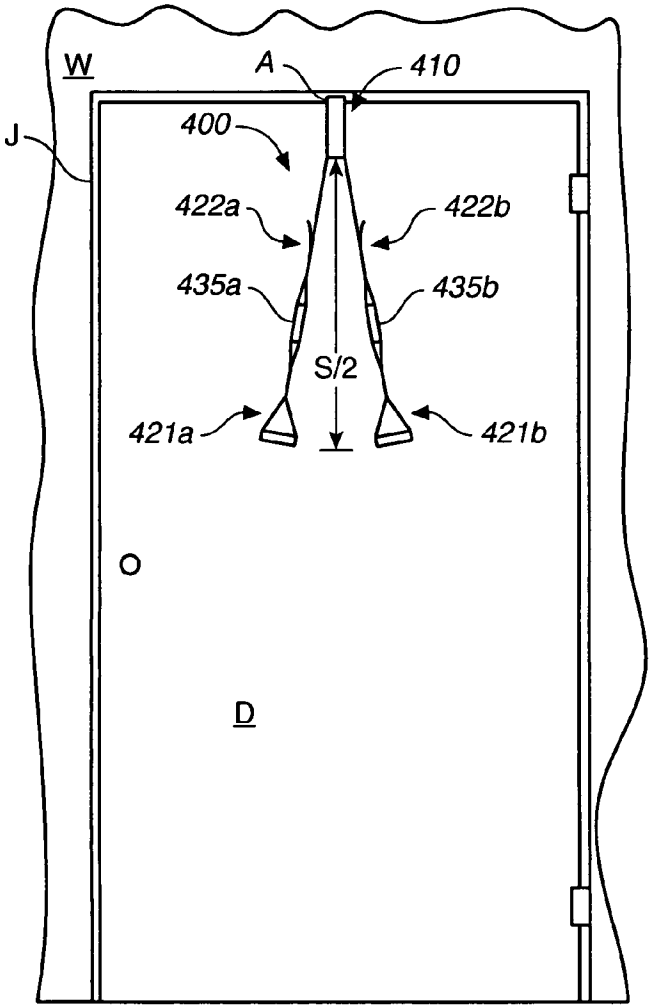
FIGS. 12A-12D are schematic drawings illustrating the lengthening and centering of the exercise device of the present invention, where
Figure 12B:
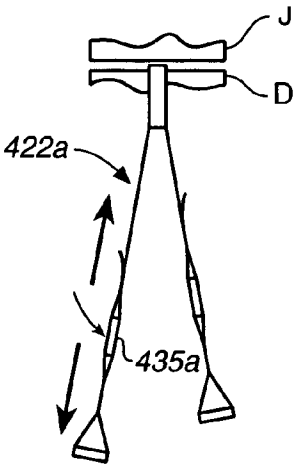
Figure 12C:
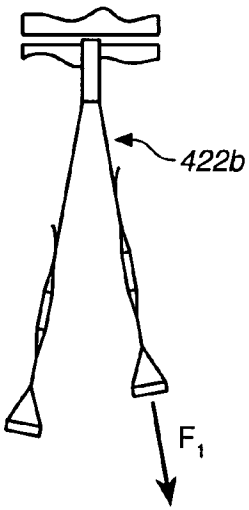
Figure 12D:
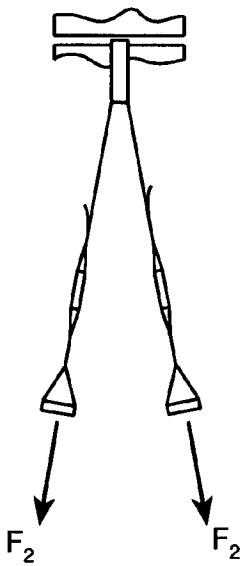
Figure 12B:
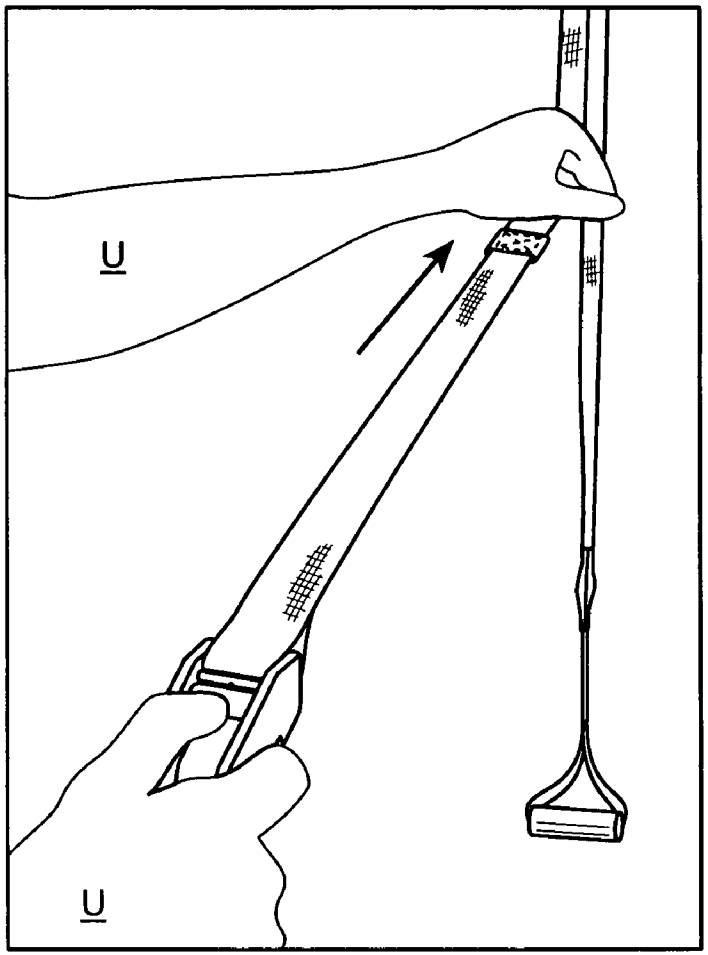
Figure 12B:
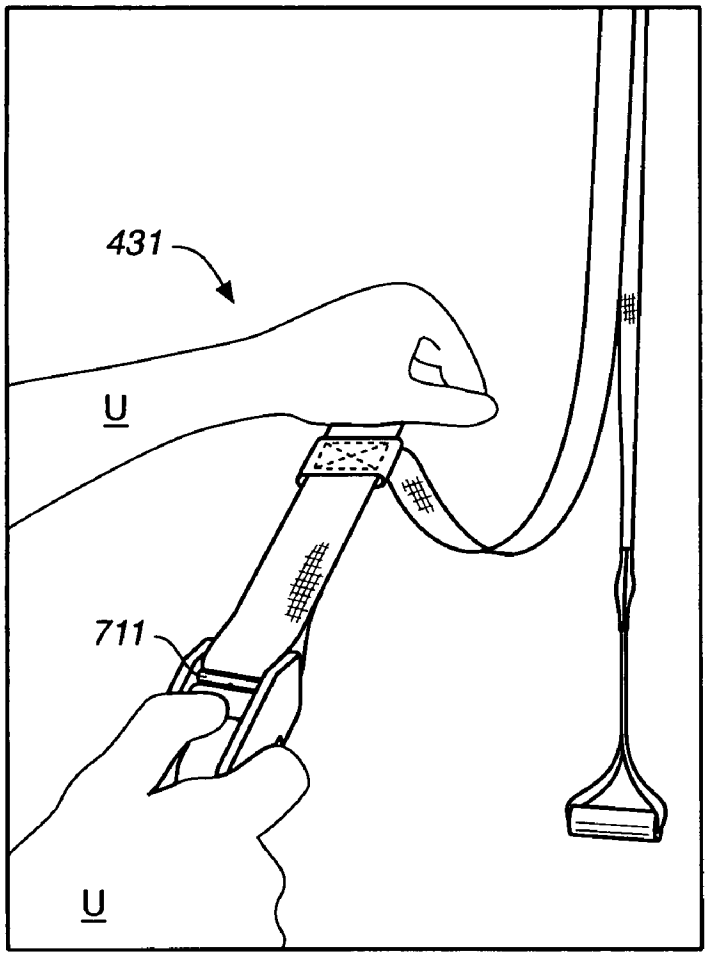

The balancing and lengthening aspects of the present invention are illustrated in FIGS. 12A-12D, where FIG. 12A is an initial configuration, FIG. 12B illustrates lengthening the elongated member 420, further illustrated in FIGS. 12B' and 12 B", FIG. 12C shows the application of force to the shorter leg of the elongated member, and FIG. 12D shows the application of force to the grips during an exercise. For illustrative purposes, FIG. 12A is assumed to be an initial configuration of an anchored device, and it is assumed that the user wishes to increase the length S while keeping the pair of arms 422 the same length (approximately one half of S). First, the user actuates one or both buckles 435. FIG. 12B schematically shows the result of actuating buckle 435*a* and elongating leg 422*a* as indicated by the arrows on that figure. FIG. 12B' shows the user U pushing cam 711 and grabbing end 431, and FIG. 12B" shows the user pulling end 431 away from the cam, as indicated by the arrow, to shorten the device.

The user then preferentially pulls on the shorter leg 422*b* as indicated by force vector $F_1$ of FIG. 12C. With both of the pair of legs 422 having approximately the same, longer length, the user can then exercise, as indicated in FIG. 12D by applying equal forces $F_2$ to each handle grip. In practice, it is not necessary for the two forces of FIG. 12D to be equal, as the application of force to legs 422 away from anchor 410 increases the friction between elongated member 420 and the anchor, allowing the lengths to not change, even under some mis-match of applied forces. Alternatively, exercise device can be adjusted to provide shorter legs 422 by pulling on end 431 to shorten the length S.

Figure 13C:
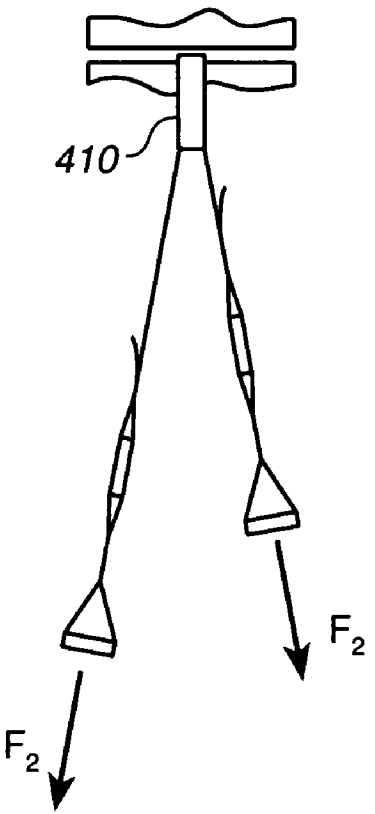
FIGS. 13A-13C are schematic drawings illustrating the lengthening and adjusting of the exercise device of the present invention having differing arm lengths, where
Figure 13B:
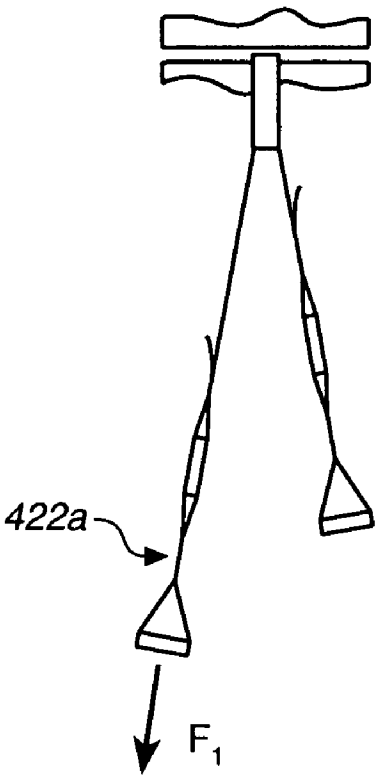
Figure 13A:
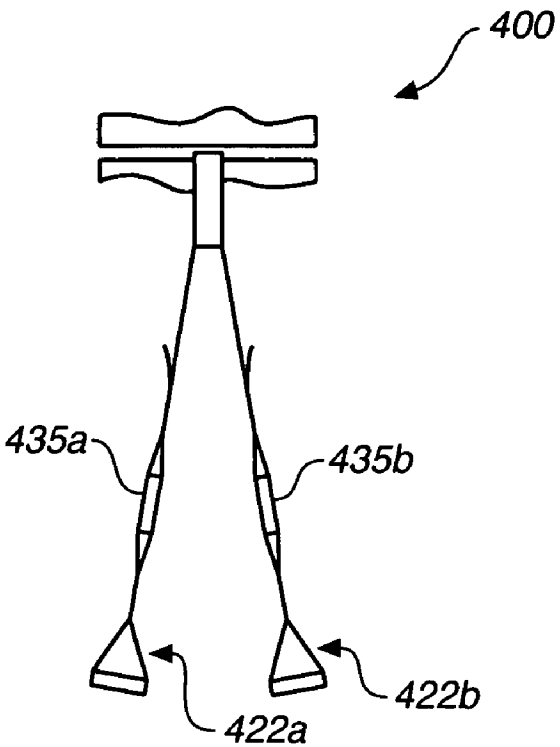

In addition to being equally balanced between the two arms, it is possible to use the inventive device to provide differing arm lengths for exercising. FIGS. 13A-13C illustrate the lengthening and adjusting of exercise device 400 having differing lengths of arms 422, where FIG. 13A is an initial configuration, FIG. 13B shows the application of force to one of the pair of arms 422, and FIG. 13C shows the application of force to the grips during an exercise. For illustrate purposes, FIG. 13A is assumed to be an initial configuration of an anchored device, and it assumed that the user wishes to adjust the length of arms 422 to different lengths. First, the user preferentially pulls on the shorter leg 422*b* as indicated by force vector $F_1$ of FIG. 13B. The user can then exercise, as indicated by the equal forces $F_2$ of FIG. 13C. In practice, it is not necessary for the two forces of FIG. 13C to be equal, since as illustrated in FIG. 12, as the application of force to legs 422 away from anchor 410 increases the friction between elongated member 420 and the anchor also increases. This limits the possibility that the arm lengths will change, even under some mis-match of applied forces. The adjustment of arms 422 to different lengths can be combined with the lengthening or shortening of the length S by actuating one or both of buckles 435.

Figure 14A:
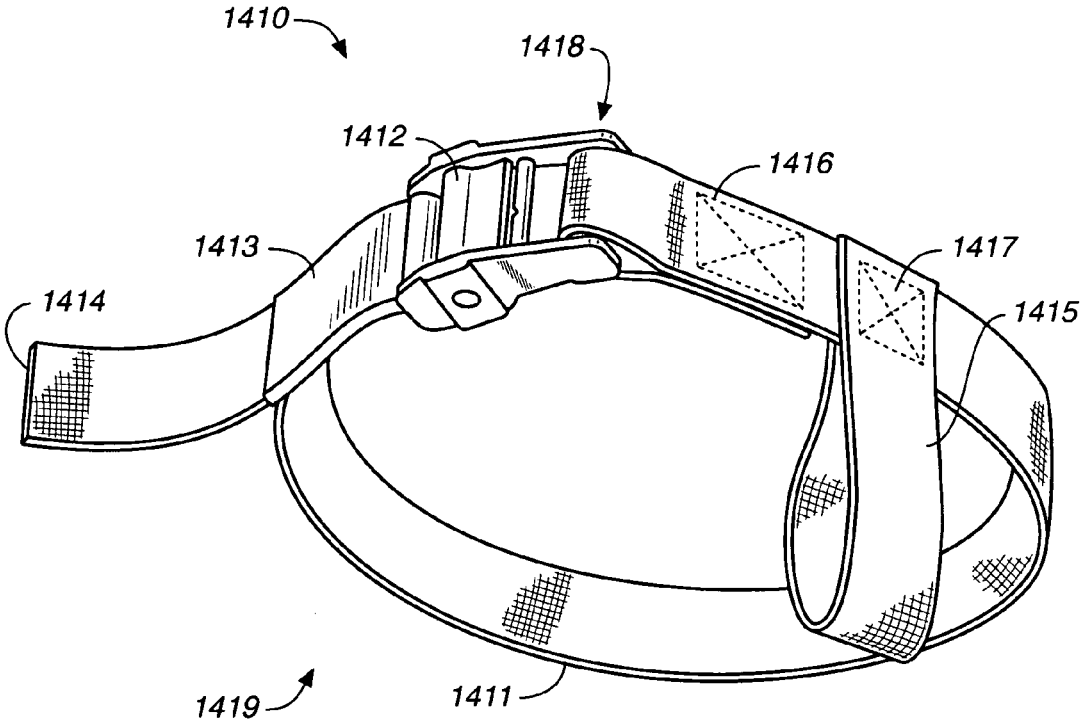
FIG. 14A is an alternate embodiment anchor that can be used for attaching the exercise device to a pole or railing.

Various mechanisms for providing a fixed anchor point are within the scope of the present invention. Thus, it is within the scope of the present invention to provide an exercise device that can be anchored in a door, about a pole, railing or stanchion, from a hook installed in a wall, or can be permanently affixed to a wall or exercise structure, for example. FIG. 14A is an alternate embodiment anchor 1410 that can be used for attaching the exercise device to a pole or railing, and FIG. 14B is an exercise device of the present invention anchored to a pole using the alternative anchoring embodiment of FIG. 14A.

FIG. 14A shows alternative embodiment anchor 1410 which includes an adjustable loop 1419 and an anchor loop 1415. As described subsequently, anchor 1410 is an alternative anchor, and can, for example, presents anchor loop 1415 for accepting strap 429 of elongate member 420 to form an exercise 1400. Adjustable loop 1419 is formed from a flexible strap 1411 and a cam buckle 1412 as follows. Cam buckle 1412 can be, for example, cam buckle 435 shown in detail in FIG. 9B. Flexible strap 1411 has a free, first end 1414 that is threaded through the cam portion of cam buckle 1412, for example by threading the strap between the second strap bar 707 and movable cam 711 of cam buckle 435. Flexible strap also has a second end 1418 that is attached to cam buckle 1412, for example, by looping the second end about first strap bar 705 of cam buckle 435 and providing a stitching 1416 through a double thickness of strap 1411. Strap 1411 thus threaded through buckle 1412 has forms an adjustable loop 1419 that can be increased or decreased in size by actuating cam buckle 1412 to release strap 1411, moving the strap through the cam buckle, and releasing the cam. End 1414 is held against strap 1411 by a slack sleeve 1413. An anchor loop 1415 is attached to strap 1411 by a stitching 1417.

It is preferred that the majority of lengths of anchor 1410 are formed of materials that include, but are not limited, to straps of a webbing of a natural or synthetic material having a strength sufficient to support the weight of a device user. Preferred webbings include, but are not limited to, webbings made of nylon, polypropylene or other polymeric fibers. It is understood that a single length of flexible material according to the present invention can alternatively comprise two or more pieces that are stitched, glued, or otherwise attached to one another.

Figure 14B:
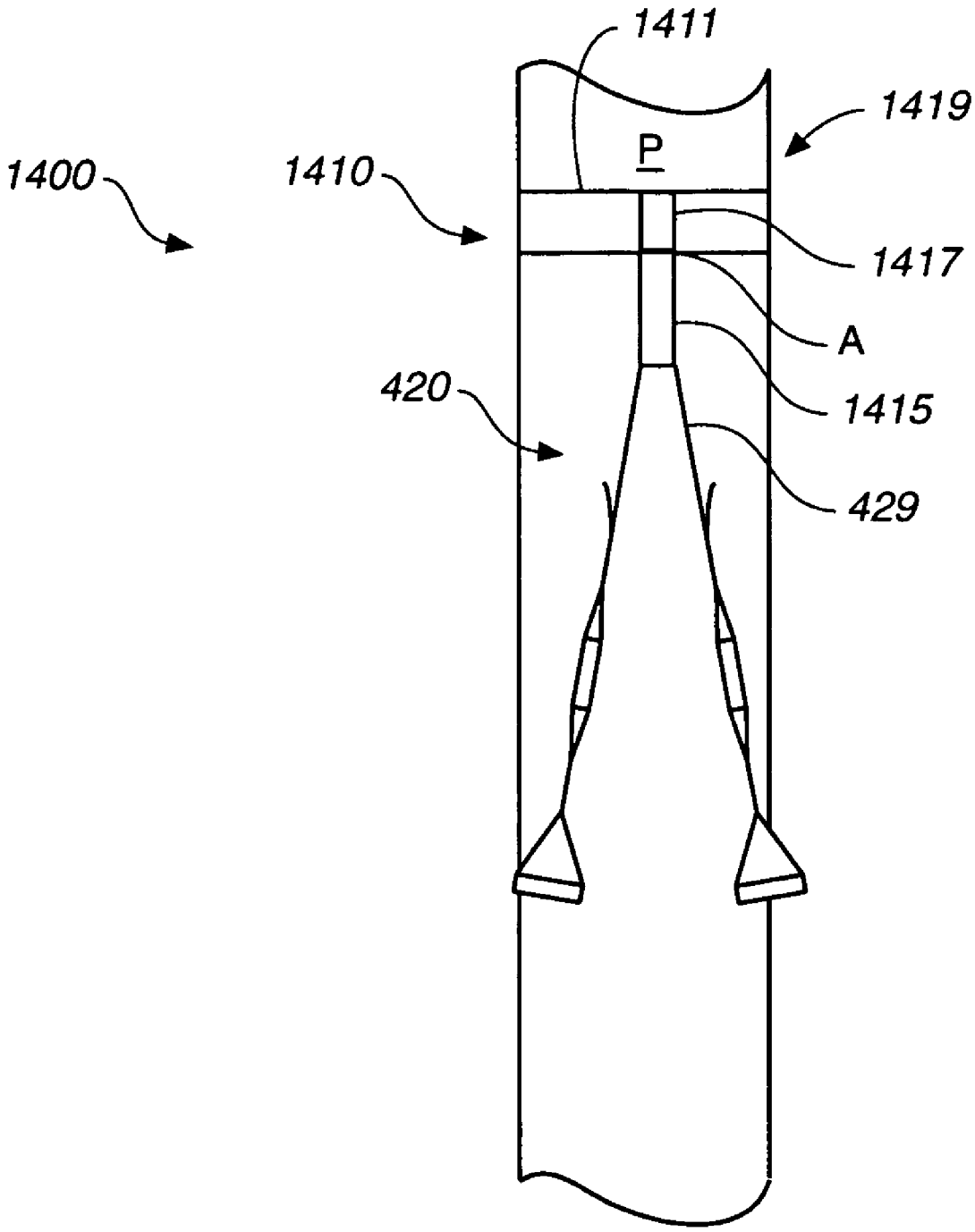
FIG. 14B is a exercise device of the present invention anchored to a pole using the alternative anchoring embodiment of FIG. 14A.

FIG. 14B shows exercise device 1400 formed from anchor 1410 and elongated member 420. Adjustable loop 1413 of anchor 1410 is tightened about a pole P, for example, by placing the adjustable loop over the top of the pole and tightened using cam buckle 1412. Alternatively, strap 1411 can unthreaded from cam buckle 1412, wrapped about pole P, and then threaded through the cam buckle and tightened. In either case, end 1414 is the pulled through cam buckle 1412 and adjustable loop 1419 is tightened about pole P with sufficient force to allow exercise device 1400 to support a user's weight.

In addition to being attached to a pole, anchor 1410 can be tensioned to support exercise device 1400 about a railing, post, or other member. Alternately, the anchor can be attached to a carbineer that is fixed to a wall or other structure.

The inventive exercise device allows for a wide range of exercises. Examples of the many exercises that are possible are presented in TABLE 1 for the inventive device placed over the top of a door. FIGS. 3 and 15 illustrate three of the many exercise positions. In each of these positions the user has selected a length for exercise device 100 or 400, adjusted as explained with reference to FIG. 12 or 13, has positioned himself on the ground a desired horizontal distance X from anchor point A with a portion of his weight being supported by the exercise device. With his weight so supported, as shown in FIGS. 3 and 15, he moves his body in directions appropriate to the type of exercise to be performed, for example by moving his body toward or away from the wall or ground, by bending his arms or legs while supporting his weight by the exercise device, or performing other movements that exercise his muscles.

Figure 15B:
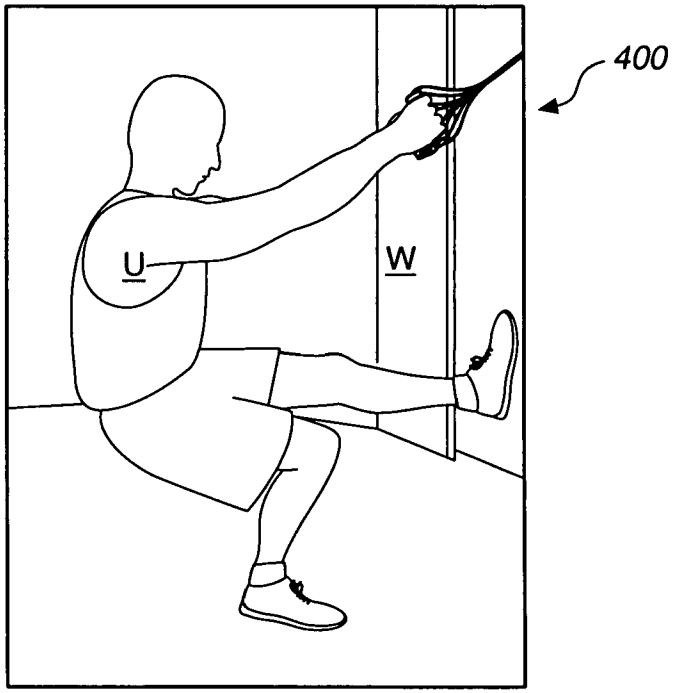
FIGS. 15A-15I illustrate poses of a user using the inventive exercise device to performing exercises, where
Figure 15A:
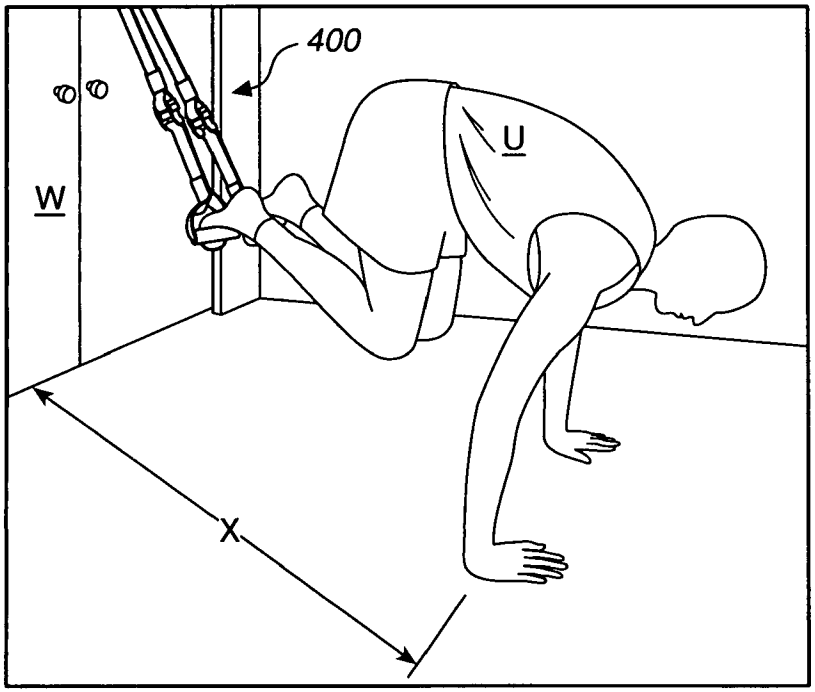
Figure 15E:
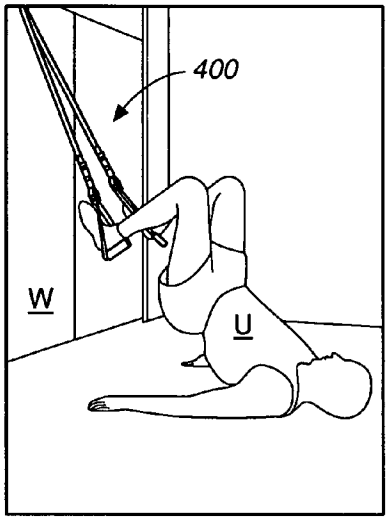
Figure 15F:
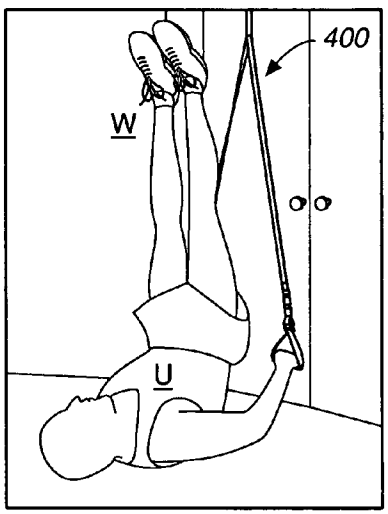
Figure 15C:
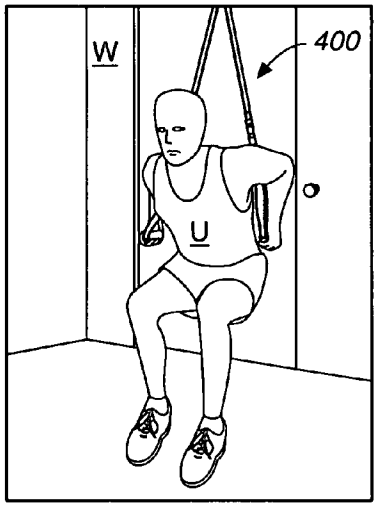
Figure 15D:
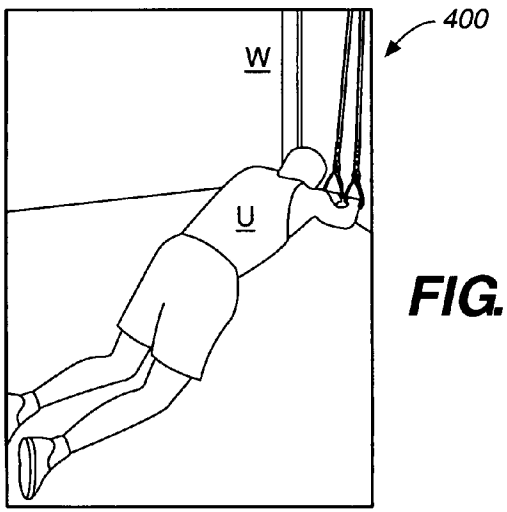
Figure 15G:
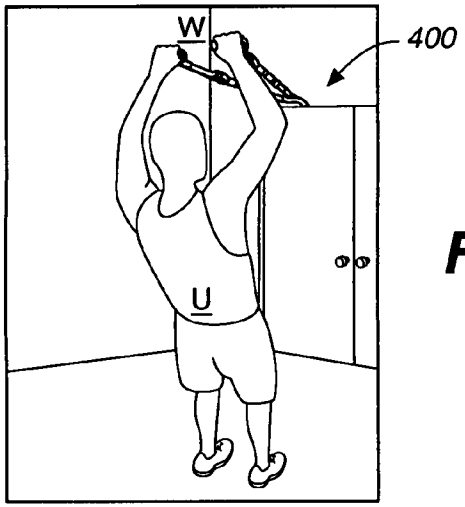
Figure 15H:
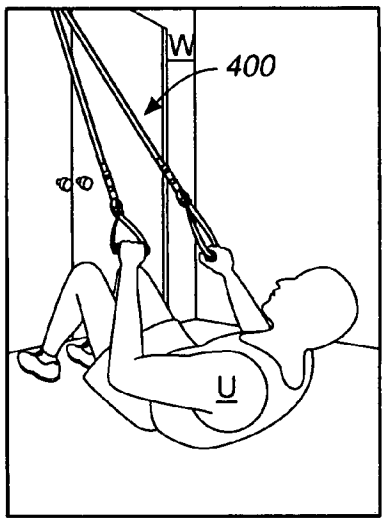
Figure 15I:
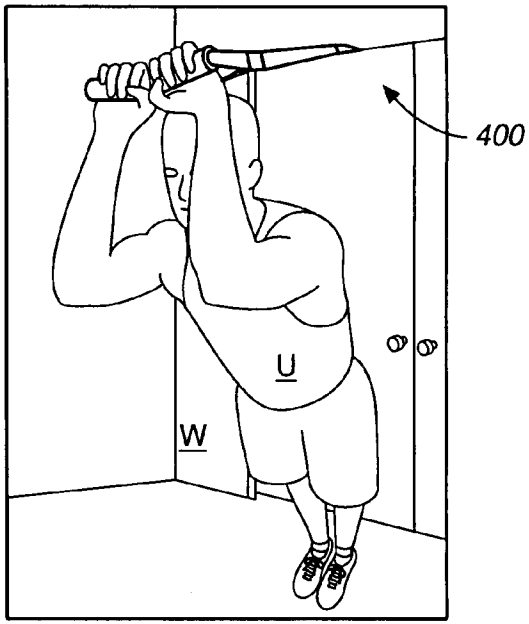

Specifically illustrated in FIGS. 3 and 15 are single poses of a user U performing a variety of exercises including a high row exercise (FIG. 3), a reverse combination crunch (FIG. 15A), a single leg L-squat (FIG. 15B), a gymnast dip (FIG. 15C), a kneeling combination crunch (FIG. 15D), a lying leg curl (FIG. 15E), a hip lift (FIG. 15F), a front shoulder raise (FIG. 15G ), a crunch (FIG. 15H), and a triceps extension (FIG. 15I). It is apparent from FIGS. 3 and 15 that many different types of exercises are possible with the inventive exercise device according to the length of the device, the positioning of the body, and how the handles are gripped.

Figure 16B:
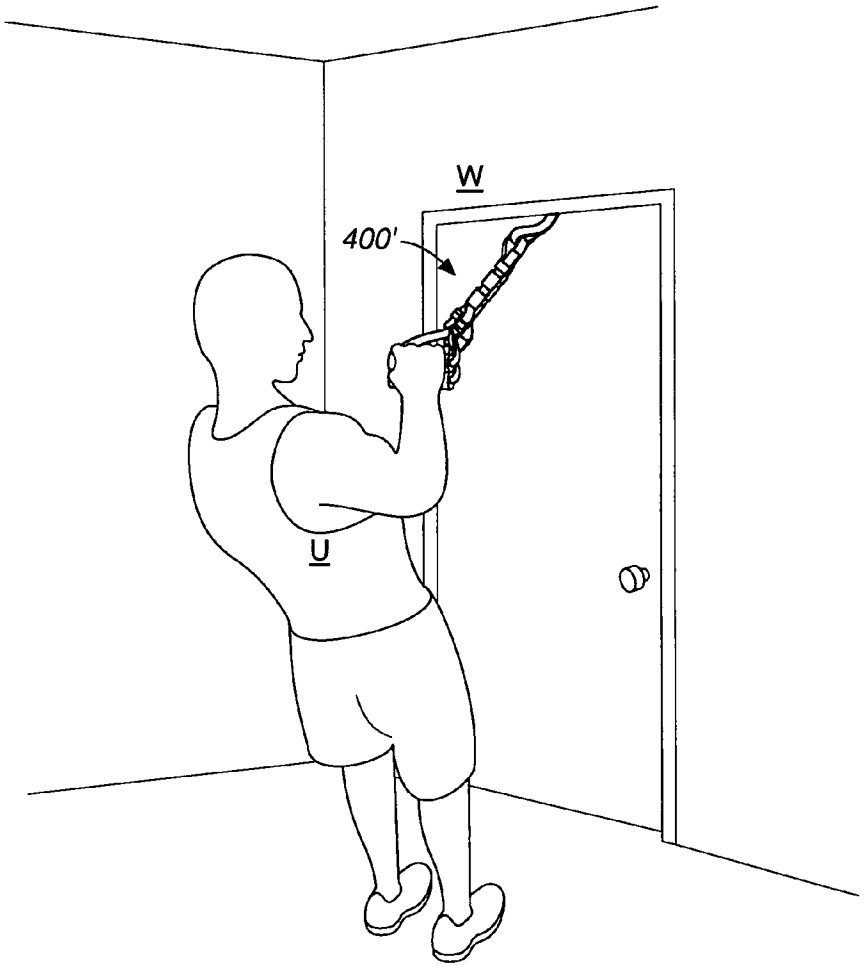
FIGS. 16A and 16B illustrate the device of the present invention for doing one handed exercises, where
Figure 16A:
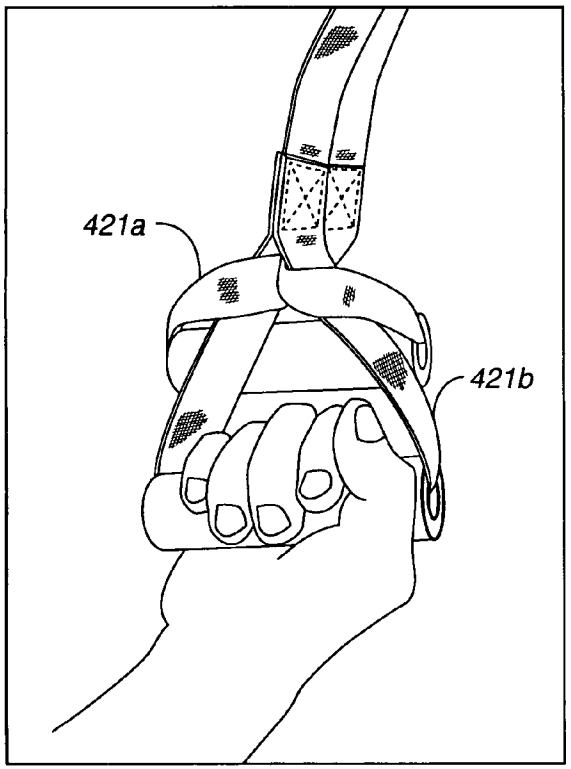

In addition, the inventive device can be used to perform one handed exercises as illustrated in FIGS. 16A and 16B. Specifically, FIG. 16A shows an exercise device 400' having interlocking the ends 421*a* and 421*b* for one handed exercises, and FIG. 16B illustrates the use of the exercise device 400' in performing a one arm high row exercise.

TABLE 1

Several Basic, Intermediate, and Advanced Over the Door Anchor Exercises.

| Basic Exercises | Intermediate | Advanced |
|---|---|---|
| Pull functions | Pull functions | Pull/lateral functions |
| Low row | One-arm low row | Lateral raise |
| High row | One-arm high row | Front shoulder raise |
| Pull-up | One-arm pull-up | Reverse-grip curl |

TABLE 1-continued

Several
Basic, Intermediate, and Advanced Over the Door Anchor Exercises.

| Basic Exercises | Intermediate | Advanced |
|---|---|---|
| High curl | One-arm high curl | Combination row/kickback |
| Low curl | One-arm low curl | Internal rotator cuff |
| Back fly | Lower chest/lat crunch | External rotator cuff |
| Wrist curl | Reverse-grip wrist curl | 2-Way forearm flexors |
| Core Strength | Core Strength | Core Strength |
| Crunch | Kneeling combination crunch | Standing combination crunch |
| Reverse single leg raise | Reverse leg raise | Reverse leg raise w/hip lift |
| Oblique crunch | V-sit-up | Reverse oblique raise |
| Reverse crunch | Hip lift | V-balance |
| Bicycle Back Bridge | Reverse bicycle | Reverse combination crunch |
| Legs | Legs | Legs |
| Squat | Lying hamstring pedal | Lying hamstring curl |
| Hip hinge | Tip-toe squat | Single-leg hip hinge |
| Squat lunge | Step-back lunge | Single leg L-squat |
| Sumo squat | Single leg squat | Diagonal Step-back lunge |
| Side-to-side lunge | Single calf raise | Crossover off-balance squat |
| Calf raise | Jumping Ski PT | |
| Push functions | Push functions | Push functions |
| Standard press | One-arm incline press | Tricep kickback |
| Chest fly | Low chest press (outside grip) | One-arm concentration fly |
| Shoulder press | Reverse Push-up | Reverse crunch/push-up combo |
| Overhead tricep extension | One-arm tricep extension | One-arm shoulder press |
| Lat-Pullovers | | Gymnast dip |

It is to be understood that this invention is not limited to those embodiments and modifications described in the specification. Modifications and variations can be made by one skilled in the art without departing from the sprit and scope of the invention. Moreover, any one or more features of any embodiment of the invention may be combined with any one or more other features of any other embodiment of the invention, without departing from the scope of the invention.

What is claimed is:

1. A method for a user to perform one or more exercises using an exercise device comprising an elongated member having a pair of ends and an anchor adapted for being supported by a structure, where said anchor includes a flexible loop and said elongated member passes through said loop, said method comprising:

adjusting a first distance between each of the pair of ends;

moving the elongated member through the flexible loop such that there is a distance between each of the pair of ends and the flexible loop;

supporting at least a portion of the user's weight from each of the pair of ends; and moving the user's body while maintaining the distance between each of the pair of ends and the flexible loop.

2. The method of claim 1, where the pair of ends is connected by said elongated member.

3. The method of claim 1, wherein said supporting includes supporting the user's weight from the exercise device by at least one hand.

4. The method of claim 1, wherein said supporting includes supporting the user's weight from the exercise device by at least one finger.

5. The method of claim 1, wherein said supporting includes supporting the user's weight from the exercise device by at least one foot.

6. The method of claim 1, wherein said supporting includes placing at least one of the user's feet on the ground.

7. The method of claim 1, wherein said supporting includes placing at least one of the user's hands on the ground.

8. The method of claim 1, wherein said supporting includes placing the user's back on the ground.

9. The method of claim 1, wherein said supporting includes placing at least a portion of the user's arm on the ground.

10. The method of claim 1, further comprising:

attaching the pair of ends together to fix the distance between each of the pair of ends and the anchor;

where said supporting includes supporting at least a portion of the user's weight from the attached pair of ends.

11. The method of claim 1, where said supporting includes:

supporting one of the user's hands from one of the pair of ends; and supporting the other of the user's hands from the other of the pair of ends.

12. The method of claim 1, where said supporting includes:

supporting one of the user's feet from one of the pair of ends; and supporting the other of the user's feet from the other of the pair of ends.

13. The method of claim 1, further comprising:

readjusting the distance between each of the pair of ends and the anchor to establish a readjusted distance between each of the pair of ends and the flexible loop; and moving the user's body while maintaining the readjusted distance.

14. The method of claim 1, where said anchor includes a single thickness strap adapted for placing between a door jamb and a closed door, and a portion to support a user's weight from said door, where said method further includes:

placing said strap between a door jamb and a closed door.

15. The method of claim 1, further comprising:

readjusting a second distance between each of the pair of ends, where said second distance is different than said first distance;

moving the elongated member through said flexible loop to establish a second distance between each of the pair of ends and the anchor; and performing a second exercise with the user supporting at least a portion of their weight from at least one of the pair of ends.

16. A method for a user to exercise against at least a portion of the user's weight using an exercise device having an inelastic elongated member with a pair of ends and an anchor to a support structure, where said anchor includes a flexible loop and said elongated member passes through said loop, said method comprising:

adjusting the length of the inelastic elongated member between the pair of ends;

moving the elongated member through the flexible loop;

supporting, from each end of the pair of ends, at least a portion of the user's weight, where said supporting increases a frictional force between said anchor and elongated member that inhibits movement of the elongated member along the anchor; and moving the user's body while maintaining fixed distances between each of the pair of ends and the flexible loop with at least a portion of the user's weight supported on the ground.

17. The method of claim 16, wherein said supporting includes supporting the user's weight from the exercise device by at least one hand.

18. The method of claim 16, wherein said supporting includes supporting the user's weight from the exercise device by at least one finger.

19. The method of claim 16, wherein said supporting includes supporting the user's weight from the exercise device by at least one foot.

20. The method of claim 16, wherein said supporting includes placing at least one of the user's feet on the ground.

21. The method of claim 16, wherein said supporting includes placing at least one of the user's hands on the ground.

22. The method of claim 16, wherein said supporting includes placing the user's back on the ground.

23. The method of claim 16, wherein said supporting includes placing at least a portion of the user's arm on the ground.

24. The method of claim 16, where said fixed distances are first fixed distances, said method further comprising:

readjusting the length of the inelastic elongated member between the pair of ends; and moving the user's body while maintaining second fixed distances between each of the pair of ends and the flexible loop.

25. The method of claim 16, where said anchor includes a single thickness strap adapted for placing between a door jamb and a closed door, and a portion attached to said strap and adapted to support the elongated member, where said method further includes:

placing said strap between a door jamb and a closed door.

26. A method for a user to perform exercises using an exercise device attached to a structure, the exercise device having a pair of ends attached by a member having an adjustable length and adapted for being supported by an anchor including a flexible loop, where the member passes through the loop, said method comprising:

adjusting the adjustable length to a first length;

moving the first length through the flexible loop to establish a first distance between each of the pair of ends and the flexible loop;

performing a first exercise with the user supporting at least a portion of their weight from at least one of the pair of ends while maintaining the established first distance between each of the pair of ends and the flexible loop;

readjusting the adjustable length to a second length different than said first length;

moving the second length through said flexible loop to establish a second distance between each of the pair of ends and the flexible loop; and performing a second exercise with the user supporting at least a portion of their weight from at least one of the pair of ends while maintaining the established second distance between each of the pair of ends and the flexible loop.

27. The method of claim 26, where performing said first exercise or performing said second exercise includes supporting the user's weight from the exercise device by at least one hand.

28. The method of claim 26, where said performing said first exercise or performing said second exercise includes supporting the user's weight from the exercise device by at least one finger.

29. The method of claim 26, where said performing said first exercise or performing said second exercise includes supporting the user's weight from the exercise device by at least one foot.

30. The method of claim 26, where said performing said first exercise or performing said second exercise includes placing the user's feet on the ground.

31. The method of claim 26, where said performing said first exercise or performing said second exercise includes placing the user's hands on the ground.

32. The method of claim 26, where said performing said first exercise or performing said second exercise includes placing the user's back on the ground.

33. The method of claim 26, where said performing said first exercise or performing said second exercise includes placing at least a portion of the user's arm on the ground.

34. The method of claim 26, further including:

placing, between a door jamb and a closed door, a single thickness strap of an anchor adapted for supporting said adjustable length.

* * * * *